United States Patent [19]

Day et al.

[11] Patent Number: 4,539,909

[45] Date of Patent: Sep. 10, 1985

[54] DETONATING ASSEMBLY WITH U-BEND OF LOW ENERGY DETONATING CORD

[75] Inventors: Philip R. Day, Toronto; William K. Webster, Willowdale, both of Canada

[73] Assignee: C-I-L Inc., North York, Canada

[21] Appl. No.: 525,695

[22] Filed: Aug. 23, 1983

[30] Foreign Application Priority Data

Sep. 28, 1982 [CA] Canada ..... 412352

[51] Int. Cl.[3] ..... C06C 5/04

[52] U.S. Cl. ..... 102/275.2; 102/275.4; 102/275.8; 102/275.5; 102/275.9; 102/275.6; 102/275.11; 102/275.7; 102/275.12; 102/205

[58] Field of Search ..... 102/205, 275.2, 275.4, 102/275.5, 275.6, 275.7, 275.8, 275.9, 275.11, 275.12

[56] References Cited

U.S. PATENT DOCUMENTS

| | | | |
|---|---|---|---|
| 1,298,418 | 3/1919 | Stokes | 102/275.5 |
| 2,327,902 | 8/1943 | Johnson | 102/275.9 |
| 3,669,021 | 6/1972 | Spencer et al. | 102/275.2 |
| 3,793,954 | 2/1974 | Johnston | 102/275.5 X |
| 4,239,003 | 12/1980 | Savitt | 102/275.5 X |
| 4,426,933 | 1/1984 | Yunan | 102/275.3 |

FOREIGN PATENT DOCUMENTS

| | | | |
|---|---|---|---|
| 521014 | 5/1940 | United Kingdom | 102/275.12 |

*Primary Examiner*—Peter A. Nelson

*Attorney, Agent, or Firm*—Donald G. Ballantyne

[57] ABSTRACT

A non-electric detonator assembly is provided for initiation by means of a connected length of low energy detonating cord. The assembly comprises a substantially conventional instantaneous or delay period non-electric blasting cap containing a detonating cord attachment plug element in its open end. The plug element is adapted to receive a secured bend of low energy detonating cord and to transmit initiating energy from the cord to the cap. Use of the assembly allows for the convenient assembly of the cord/cap combinations in the field and eliminates wasted cord.

3 Claims, 2 Drawing Figures

14
18
21
15
20
19
13
17
12
11
10
9
7
8
6
1
4
5
3
2

16
17
1

DETONATING ASSEMBLY WITH U-BEND OF LOW ENERGY DETONATING CORD

BACKGROUND OF THE INVENTION

The present invention relates to the art of blasting with explosives and to the use of non-electric delay detonators. More particularly, the invention relates to a non-electric detonator assembly which may simply and conveniently be attached to an initiating length of low energy detonating cord in the field.

To avoid the hazards associated with the use of electrical initiation systems for detonating explosive charges, wide use is now made of non-electric blasting caps, both delay and non-delay, which caps are initiated by means of a connected length of low energy detonating cord (LEDC). To initiate a charge of explosives placed in, for example, a borehole, a detonator (blasting cap) is fitted with a length of LEDC by crimping one end of the LEDC into the detonator. The detonator is placed in contact with the blasting charge (or an appropriate booster) in the borehole and the remote end of the LEDC is initiated. The shock transmitted along the LEDC sets off the attached detonator which, in turn, initiates the blasting charge or booster. Networks of such charges can be provided to produce time-delay blasting and are shown for example, in U.S. Pat. No. 3,878,785. An essential component of these disclosed methods is the factory-assembled, non-electric detonator (whether instantaneous or delay) having an integral length or "tail" of LEDC inserted therein. These LEDC tails are, by the use of appropriate connecting devices as shown in U.S. Pat. No. 3,878,785 or U.S. Pat. No. 3,175,491, brought into contact with an initiator, generally a trunk line of detonating cord.

There has been a need in the blasting art for an LEDC-initiated detonator which may be attached to the LEDC in the field. Such a detonator would reduce the requirement to supply factory-assembled units having various LEDC tail lengths and, consequently, would reduce inventories and manufacturing problems. In the field, the blasting technician could adjust the length or tail of LEDC as required as he prepared his blasting network and hence reduce waste.

SUMMARY OF THE INVENTION

The present invention provides an LEDC-initiated detonator assembly adapted for manual connection to a chosen length of LEDC, which assembly comprises a tubular shell closed at its bottom end, at least one explosive charge located in the bottom of said shell, an ignition charge adjacent to said explosive charge, a sealer element adjacent said ignition charge and a hollow tubular plug LEDC attachment element adjacent said sealer element and within the said shell, the said hollow plug attachment element having a portion extending beyond the open end of said shell, the said extended portion comprising an integral empty, substantially flat U-shaped container having an internal dimension adapted to receive a U-bend of LEDC between spaced-apart faces, each of the said spaced faces having at a central loci a perforation therethrough aligned to receive an inserted, free end length of LEDC, the said hollow plug element within the said shell having an initiation transmission charge therein, the said initiation transmission charge being separated from the said integral, flat U-shaped container by thin-walled, rupturable membrane. Optionally, the tubular shell may also contain a delay element between the said sealer element and the said ignition charge.

BRIEF DESCRIPTION OF DRAWING

The detonator assembly of the invention may be more clearly understood by reference to the accompanying drawing which illustrates in FIG. 1 a cross-sectional view of a non-electric delay detonator assembly containing an LEDC attachment element and connected length of LEDC, and in FIG. 2, a view of the assembly of FIG. 1 taken at 90°.

DETAILED DESCRIPTION AND PREFERRED EMBODIMENT

Figure 1:
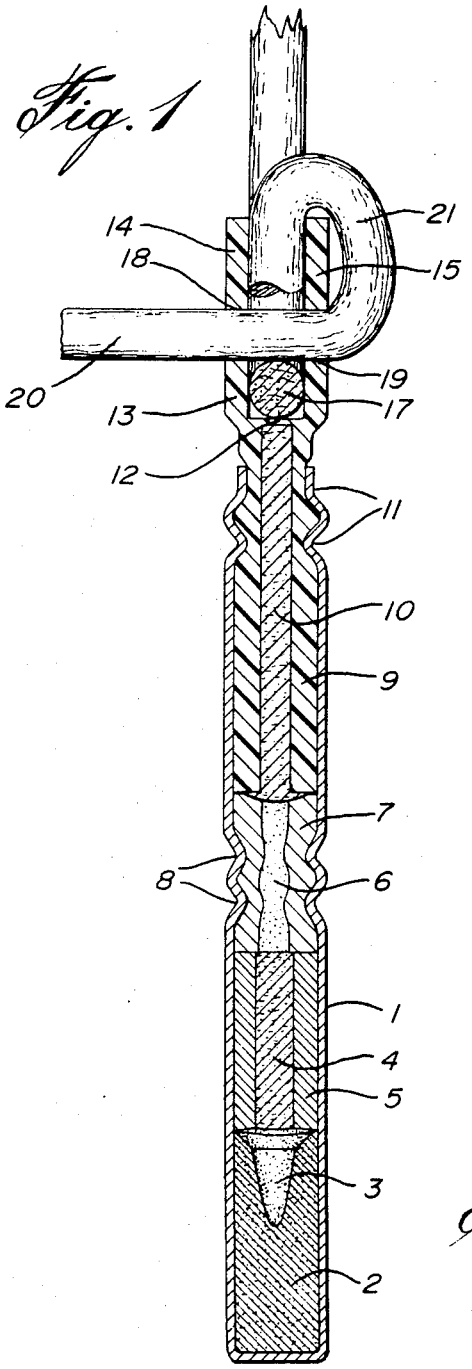
Figure 2:
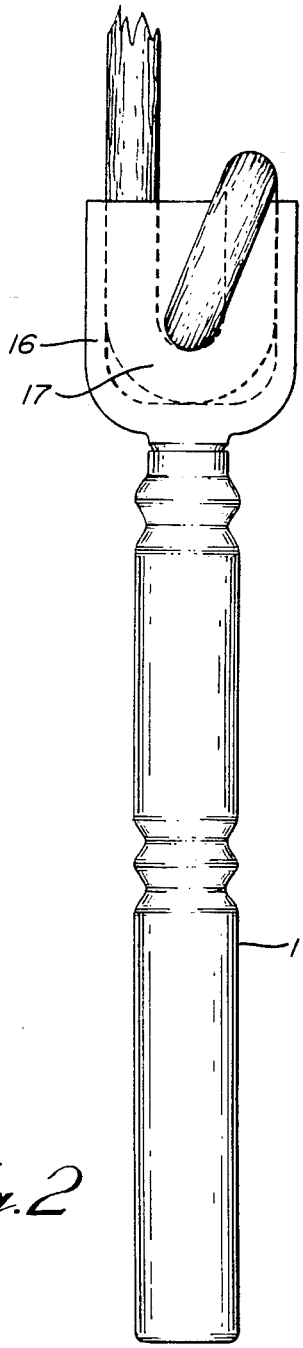

With reference to the Figures of the drawing, 1 designates a metal tubular shell closed at its bottom end and having a base charge of explosives 2 pressed or cast therein. 3 represents a primer charge of heat sensitive explosive. A delay train or composition is shown at 4 contained within a drawn lead tube or carrier 5. Surmounting delay charge 4 is an ignition charge 6 contained in carrier 7. Carrier 7 is retained in position within tube 1 by means of circumferential indentations or crimps 8. Above ignition charge 6 is a hollow plug element 9 containing a charge of sensitive explosive 10 of, for example, lead azide or fine grain PETN. Plug element 9 is locked in place within shell 1 by means of crimps 11. At the upper end of plug element 9 is an integral, rupturable diaphragm or membrane 12. Membrane 12 provides waterproofness for the sensitive explosive 10 in hollow plug 9 and for the ignition and explosive materials within shell 1. Membrane 12 is sufficiently thin to permit rupture and transfer of an initiating charge from an adjacent, detonating LEDC to the sensitive explosive 10. The thickness of membrane 12 will vary with the material of construction. Integral with the upper end of element 9 and membrane 12 is a substantially U-shaped container or holder 13. Container 13 comprises spaced-apart faces 14 and 15 integral with a connecting apron 16 which extends along the upright edges of faces 14 and 15. The space between faces 14 and 15 is sufficient to provide a substantially tight fit to an inserted U-bend of LEDC 17. Faces 14 and 15 contain central perforations 18 and 19 of a size to allow substantially tight passage therethrough of the end 20 of the U-bend LEDC 17 which is shown looped at 21.

In use in the field where a blasting technician is preparing, for example, a network of time-delay blasting charges in boreholes, the blaster will select from a supply of factory made detonator assemblies of the invention those having the required time-delay period for his intended purpose. The blaster will attach appropriate cut lengths of LEDC to each detonator assembly by inserting a U-bend section 17 of the LEDC into the container element 13, looping the free end 20 of the LEDC and passing it through apertures or perforations 18 and 19 to secure LEDC 17 within container 13 and to press an outer surface of LEDC 17 close to membrane 12. A sufficient length of LEDC end 20 will be chosen so that any moisture penetration into LEDC end 20 will not desensitize the LEDC at the position of U-bend 17. A moisture-proofing treatment, for example, a lacquer dip, can be given to LEDC end 20. After securing LEDC 17 within container element 13, the blaster will place detonator shell 1, in initiating contact with the booster or explosive charge to be detonated (not shown) and place the charge in a borehole. The LEDC end remote from the detonator assembly will be connected to an initiator, for example, a trunk line of detonation cord, by which means the detonator assemblies are set off. Upon initiation from, for example, a connected trunk line (not shown), LEDC 17 detonates which detonation causes rupture of membrane 12. Shock and flame from LEDC 17 initiates the sensitive explosive 10 within hollow plug element 9. This, in turn, ignites charge 6 in plug element 7 and sets off delay train 4. Delay train 4, in turn, initiates primer charge 3 and explosive charge 2.

The hollow, tubular LEDC attachment element and integral container is conveniently made by conventional molding techniques from thermoplastic material including rubber. Polyethylene of a density of about 0.92 has been found very suitable but it will be apparent to one skilled in the art that other kinds of materials may be successfully employed. It should be appreciated, however, that a material subject to undue hardening in cold temperatures or subject to undue softening in warm temperatures would not be preferred since some degree of resilience is desirable. Furthermore, a material which readily lends itself to fabrication into the desired shape, such as by moulding by modern methods, is to be preferred in the interest of economy.

It will be apparent from the above that use of the novel detonator assembly of this invention is particularly advantageous in the field since the blasting technician has the freedom to employ LEDC initiators of optimum length and thus can enjoy economics in material use. The connection of the LEDC initiator to the detonator assembly is effected simply, quickly and securely and the right-angled junction point between the LEDC and the membrane-protected charge within the hollow plug element assures propagation. The nature of the threaded connection of the LEDC assures that the LEDC line will not be dislodged from the assembly during handling and borehole filling. Because of the moisture and temperature resistant nature of the assembly, it may be used under all conditions normally encountered at blasting sites.

We claim:

1. A non-electric explosive detonator assembly comprising a tubular shell closed at its bottom end, at least one explosive charge located in the bottom of said shell, an ignition charge adjacent to said explosive charge, a sealer element adjacent said ignition charge and a hollow tubular plug element adjacent said sealer element and within the said shell, the said hollow plug element having a portion extending beyond the open end of said shell, the said extended port i on comprising an integral, empty, substantially flat, U-shaped container having an internal dimension adapted to receive a U-bend of low energy detonating cord between spaced-apart faces, each of the said spaced faces having at a central loci a perforation therethrough aligned to receive an inserted free end length of the said low energy detonating cord, the said hollow plug element within the said shell having an initiation transmission charge therein, the said initiation transmission charge being separated from the said integral flat U-shaped container by a thin-walled, rupturable membrane.

2. A detonator assembly as claimed in claim 1 wherein the said tubular shell also contains a delay charge element.

3. A detonator assembly as claimed in claim 1 wherein the said hollow plug element and extending container portion comprise a moldable thermoplastic material.

* * * * *